US007234696B2

(12) United States Patent
Focke et al.

(10) Patent No.: US 7,234,696 B2
(45) Date of Patent: Jun. 26, 2007

(54) METHOD OF, AND APPARATUS FOR, HANDLING BLANKS, IN PARTICULAR COUPONS

(75) Inventors: Heinz Focke, deceased, late of Verden (DE); by Jurgen Focke, legal representative, Verden (DE); by Doris Focke, legal representative, Verden (DE); Stephan Bachner, Verden (DE); Jens Schmidt, Grasberg (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 223 days.

(21) Appl. No.: 10/728,091

(22) Filed: Dec. 5, 2003

(65) Prior Publication Data

US 2004/0164483 A1 Aug. 26, 2004

(30) Foreign Application Priority Data

Dec. 9, 2002 (DE) ..... 102 57 598

(51) Int. Cl.
*G65H 29/00* (2006.01)
*B65B 63/00* (2006.01)

(52) U.S. Cl. ..... 271/185; 271/275; 53/520

(58) Field of Classification Search ..... 271/9.01, 271/9.12, 9.13, 185, 264, 184, 275; 53/435, 53/238, 475, 505, 520, 249; 198/460.1; 206/469, 206/449

See application file for complete search history.

(56) References Cited

U.S. PATENT DOCUMENTS

| | | | | |
|---|---|---|---|---|
| 4,304,485 | A * | 12/1981 | Povio | 399/408 |
| 4,724,946 | A | 2/1988 | Cinotti et al. | |
| 4,929,226 | A | 5/1990 | Focke et al. | |
| 5,330,174 | A * | 7/1994 | Ricciardi | 271/297 |
| 5,588,280 | A | 12/1996 | Kotsiopoulos et al. | |
| 5,590,507 | A * | 1/1997 | Wyssmann | 53/399 |
| 6,688,593 | B1 * | 2/2004 | Auerbach | 271/184 |
| 6,942,216 | B1 * | 9/2005 | Koelle | 271/270 |

FOREIGN PATENT DOCUMENTS

| | | |
|---|---|---|
| DE | 33 31 672 A1 | 3/1985 |
| DE | 40 27 247 A1 | 8/1991 |
| DE | 41 33 404 A1 | 4/1993 |
| DE | 36 34 489 C2 | 3/1996 |
| DE | 109 41 526 A1 | 3/2000 |
| DE | 198 41 526 A1 | 3/2000 |

* cited by examiner

*Primary Examiner*—Patrick Mackey
*Assistant Examiner*—Kaitlin Joerger
(74) *Attorney, Agent, or Firm*—Sughrue Mion, PLLC

(57) ABSTRACT

For producing (cigarettes) packs (10) with a coupon positioned between the pack and outer wrapper made of film, the coupons are supplied to a packaging machine for the outer wrapper and are transported in the region of the packaging machine by a coupon conveyor (17). The coupons pass into the region of a feeder (20) and are applied by the latter to a free top side (13) of the packs.

16 Claims, 9 Drawing Sheets

Fig.6
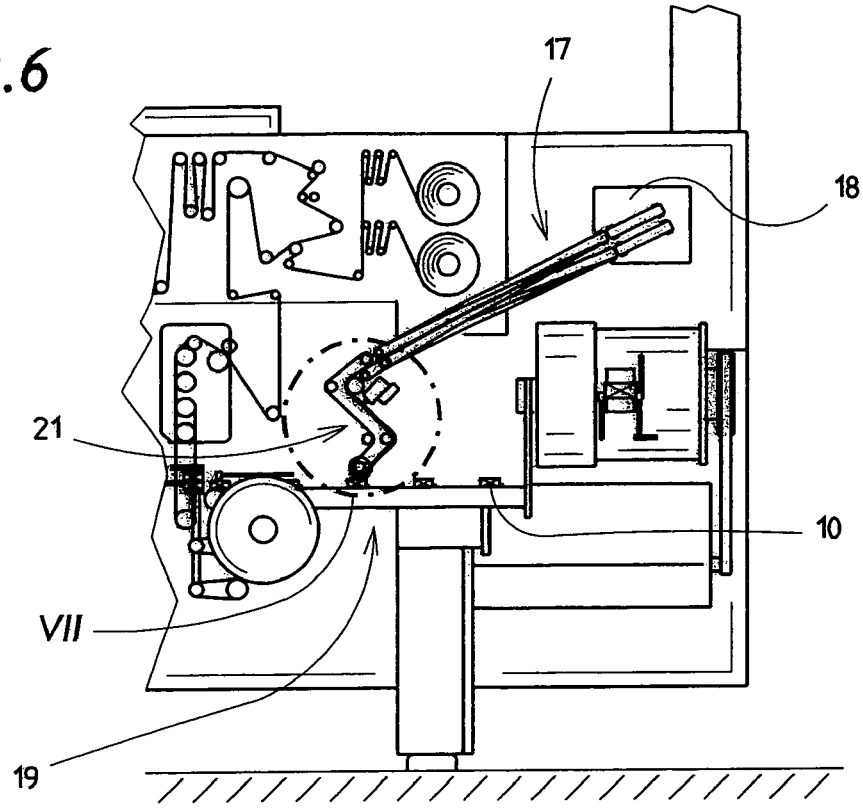
Fig.11
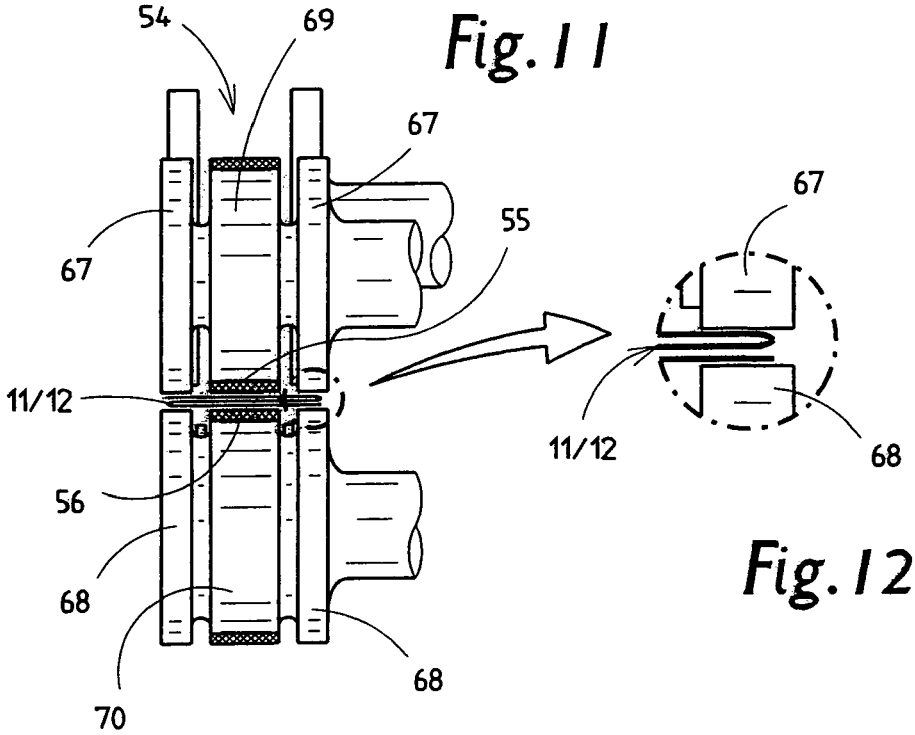
Fig.12

METHOD OF, AND APPARATUS FOR, HANDLING BLANKS, IN PARTICULAR COUPONS

BACKGROUND OF THE INVENTION

The invention relates to a method of handling blanks, in particular of supplying printing carriers, coupons or the like as an insert to a pack—cigarette pack. The invention also relates to an apparatus for implementing the method.

The task of adding printing carriers, that is to say thin folded or non-folded blanks with information and/or advertising, to a pack is becoming increasingly frequent in packaging technology. This applies particularly to cigarette packs. The insert is referred to hereinbelow, irrespective of the configuration, as a coupon.

The coupons, which are produced elsewhere, are to be supplied to the (cigarette) pack and applied to the latter. An outer wrapper made of film integrates the coupon in the pack, with the result that the coupon is to hand when the pack is opened for the first time by removal of the outer wrapper.

SUMMARY OF THE INVENTION

The object of the invention is to integrate the handling of the coupons in the packaging process such that the coupons can be combined with the pack without the (high) performance of packaging machines being adversely affected.

In order to achieve this object, the method according to the invention is characterized by the following features:

a) the coupons are supplied in adjacent pairs in each case, in particular on account of a double coupon being severed, b) the coupons are supplied to a coupon feeder in order to be applied to a top side of a pack, c) the coupons arriving in pairs are separated during transportation to the coupon feeder such that individual coupons are supplied one after the other to the coupon feeder.

The handling of the coupons in the region of the coupon feeder can be carried out in different ways. One special feature is constituted by the introduction of the coupons into a coupon magazine with at least one supply shaft. The coupons are removed from the coupon magazine individually by the correspondingly designed coupon feeder. As an alternative, the invention provides a specifically designed coupon feeder which receives the incoming coupons directly and supplies them to the packs without (continuous) transportation being interrupted.

In the case of the apparatus according to the invention, the coupons can be transported in the region of a packaging machine by a coupon conveyor, to be precise either to a coupon magazine or directly to a coupon feeder. The packaging machine preferably serves for applying an outer wrapper made of film (cellophane) to cigarette packs, the coupons being applied to an upwardly directed rear side of the cigarette packs and the resulting unit then being enclosed by the film in the customary manner. The design of the coupon magazine, on the one hand, and of the directly charged coupon feeder, on the other hand, each constitute a special feature.

BRIEF DESCRIPTION OF THE DRAWINGS

Further features of the invention are explained in more detail hereinbelow with reference to exemplary embodiments illustrated in the drawings, in which:

FIG. 6 shows a partial view of the packaging machine, analogous to FIG. 2, for another exemplary embodiment of coupon handling, FIG. 11 shows a detail of the coupon feeder according to FIG. 7, namely a cross section through section plane XI-XI, FIG. 12 detail of the unit according to FIG. 11 in enlarged scale.

DETAILED DESCRIPTION OF THE INVENTION

Figure 1:
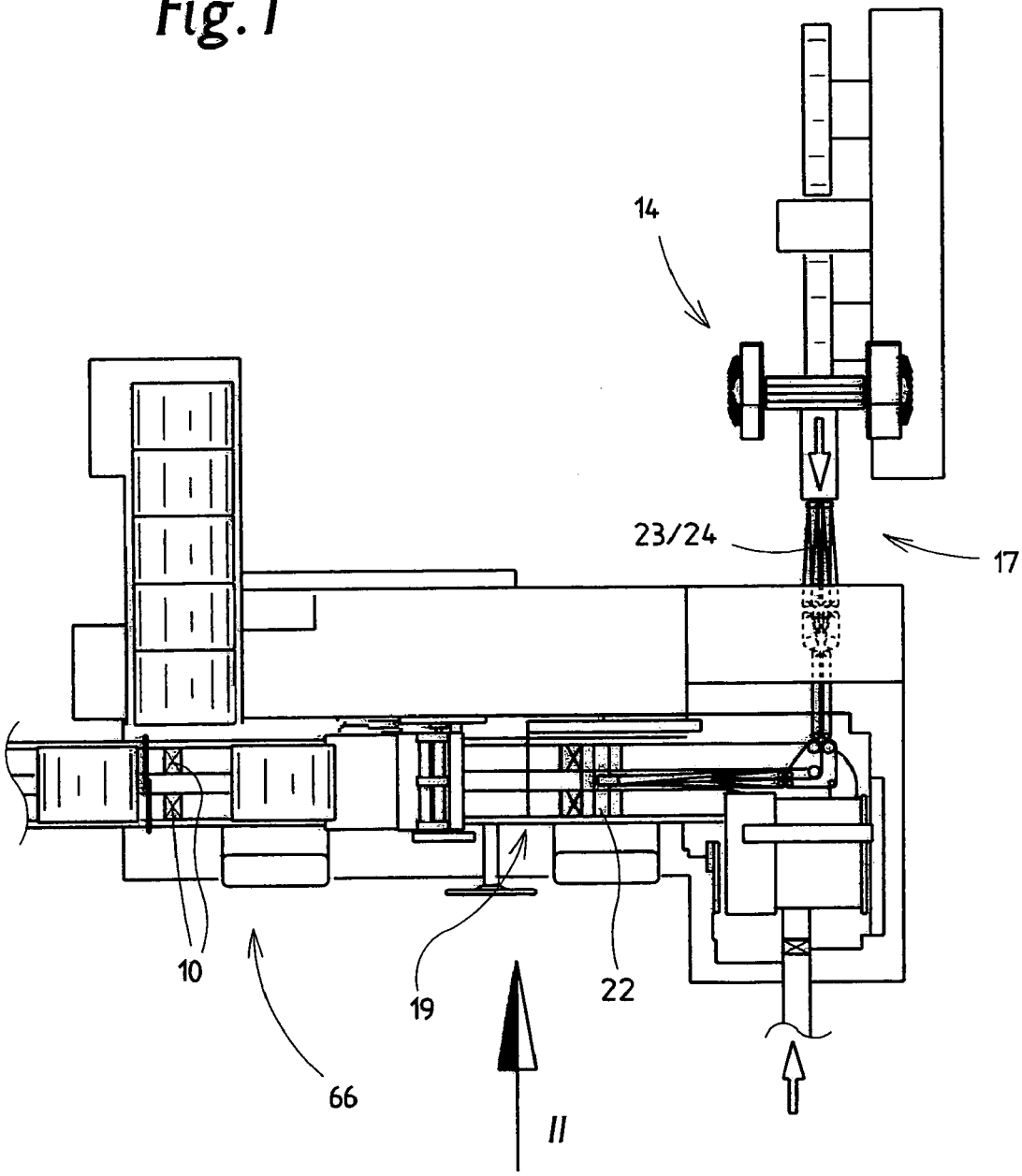
FIG. 1 shows a schematic plan view of a packaging machine with coupon subassembly.

The exemplary embodiments illustrated in the drawings relate to the production of cuboidal packs 10, to be precise cigarette packs in particular. A possibly folded blank with printing on it, namely a coupon 11, 12, is to be added as an insert to each pack 10. The coupons 11, 12 are combined with the packs 10 in the region of a packaging machine for applying an outer film wrapper to the pack 10. The coupon 11, 12 is applied to a top side 13 of the pack 10 and, together with the pack 10, enclosed by the outer wrapper. It is customary to apply the coupon 11, 12 to a rear side of the pack 10.

Figure 3:
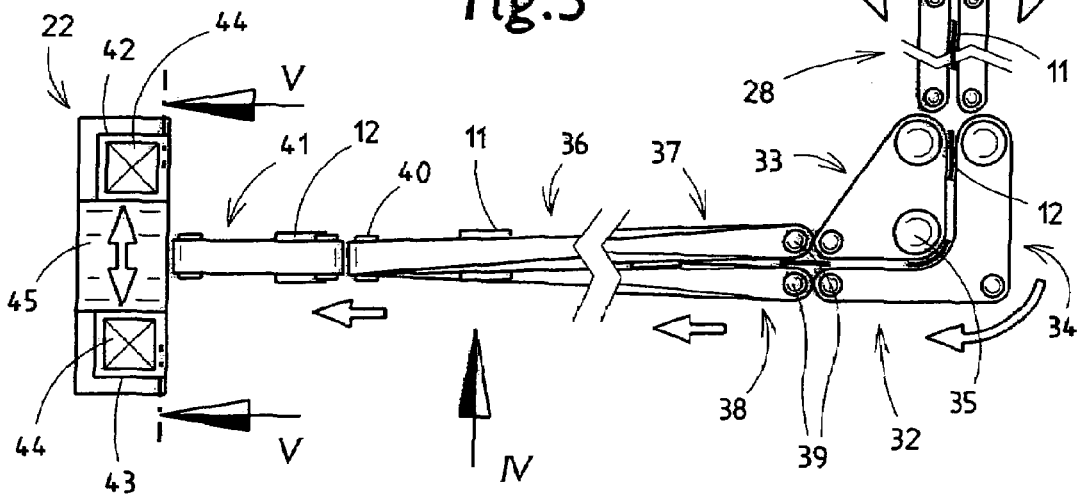
FIG. 3 shows, on an enlarged scale, a plan view of a coupon conveyor with coupon magazine.

The coupons 11, 12 are produced by a coupon subassembly 14 of known construction. The coupon subassembly 14 is designed such that double coupons 15 are produced and the latter are severed in the center with the aid of a cutter disc 16. This produces two adjacent coupons 11, 12 (FIG. 3).

The coupon subassembly 14 is positioned—preferably as a separate unit—on a rear side of the packaging machine. The coupons 11, 12 are received by a coupon conveyor 17 outside the packaging machine and supplied, via an aperture 18 in the packaging machine, to the front region, namely to a plane above a conveying path 19 for the packs 10. The coupon conveyor 17 comprises a plurality of belt conveyors which interact and/or follow one after the other and cause the coupons 11, 12 to be deflected—more or less at right angles—in the region of the packaging machine (FIGS. 1 and 3).

Figure 2:
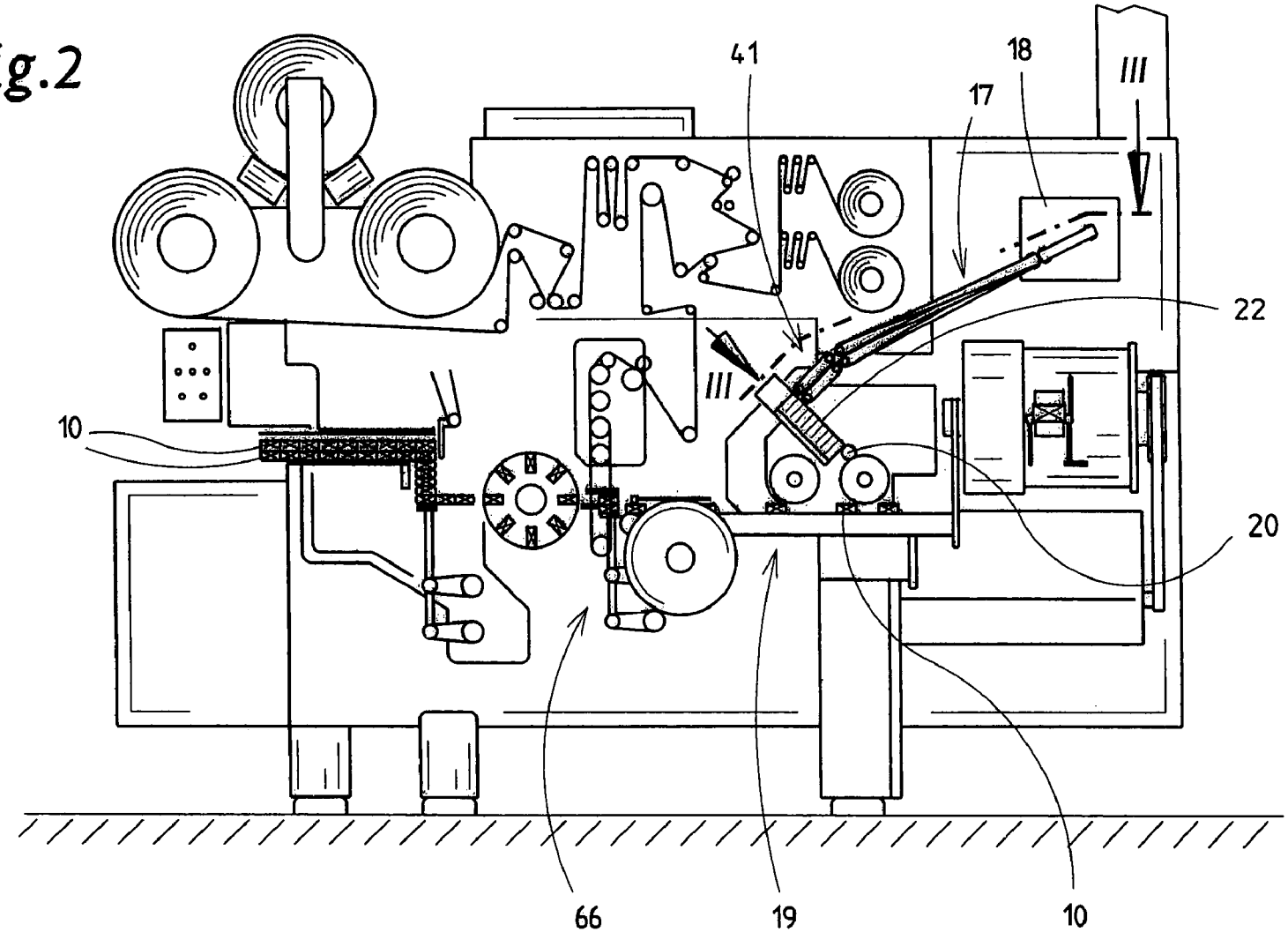
FIG. 2 shows the packaging machine according to FIG. 1 in a side and/or front view in the direction of arrow 11 in FIG. 1.
Figure 4:
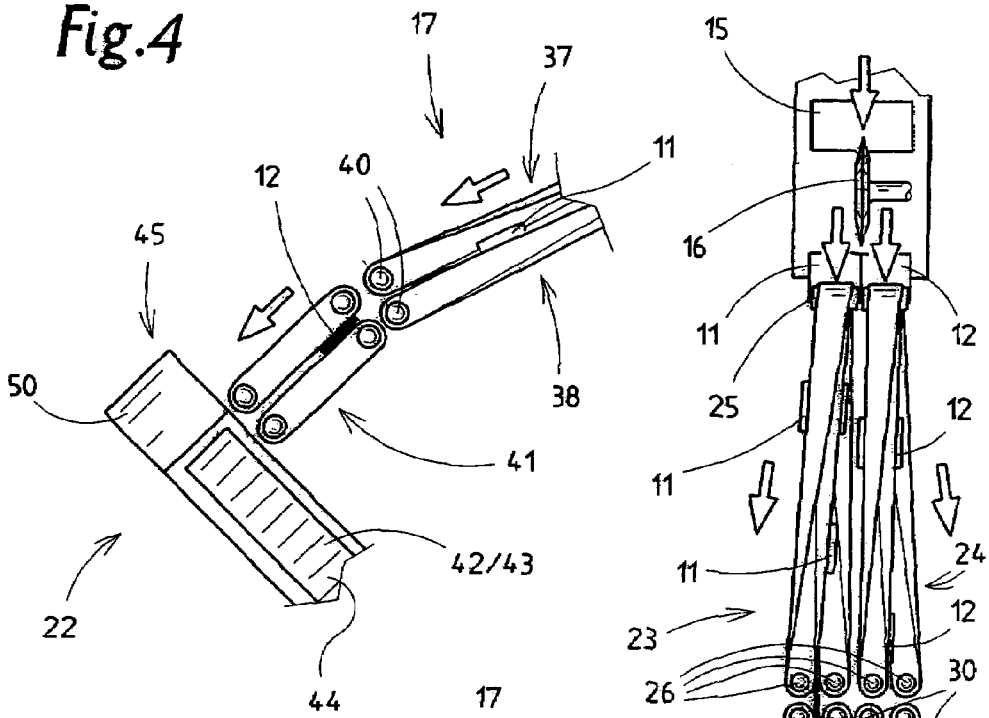
FIG. 4 shows a detail of the coupon conveyor according to FIG. 3 in a side view in the direction of arrow IV.

The coupons 11, 12 are supplied to the respective pack 10, and applied to the top side 13, by a (coupon) feeder 20, 21 arranged above the conveying path 19 of the packs 10. Two different designs are possible. The coupons 11, 12 may be supplied by the coupon conveyor 17 to a coupon magazine 22 and stored therein. Individual coupons 11, 12 are removed from the coupon magazine 22 by the feeder 20 (FIG. 2) and supplied to the respective pack 10. In this configuration, the feeder 20 is designed in the customary manner.

Figure 8:
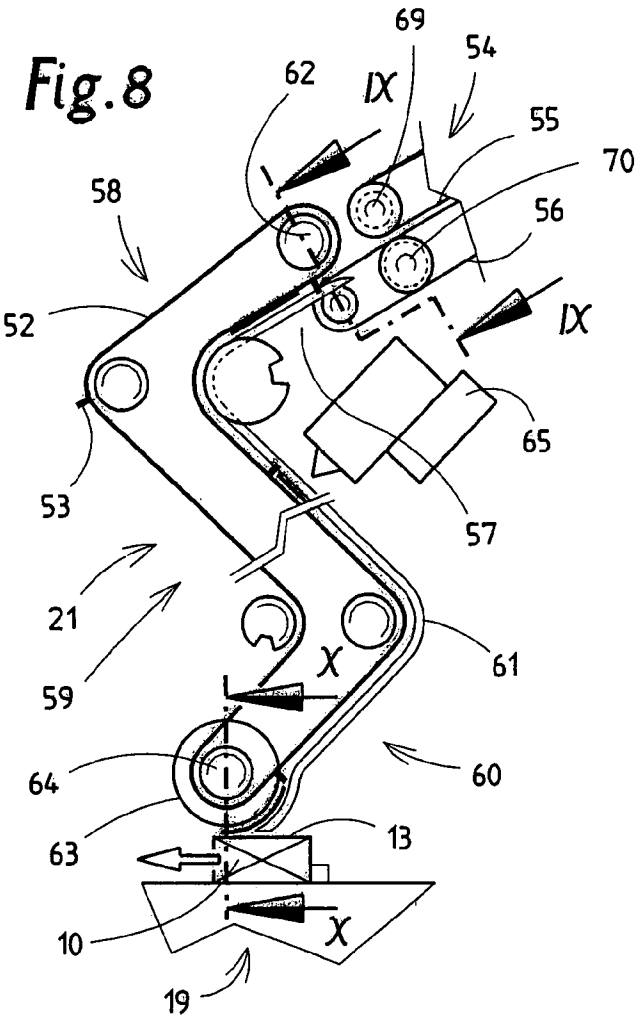
FIG. 8 shows the coupon feeder according to FIG. 7 with different relative positioning.
Figure 7:
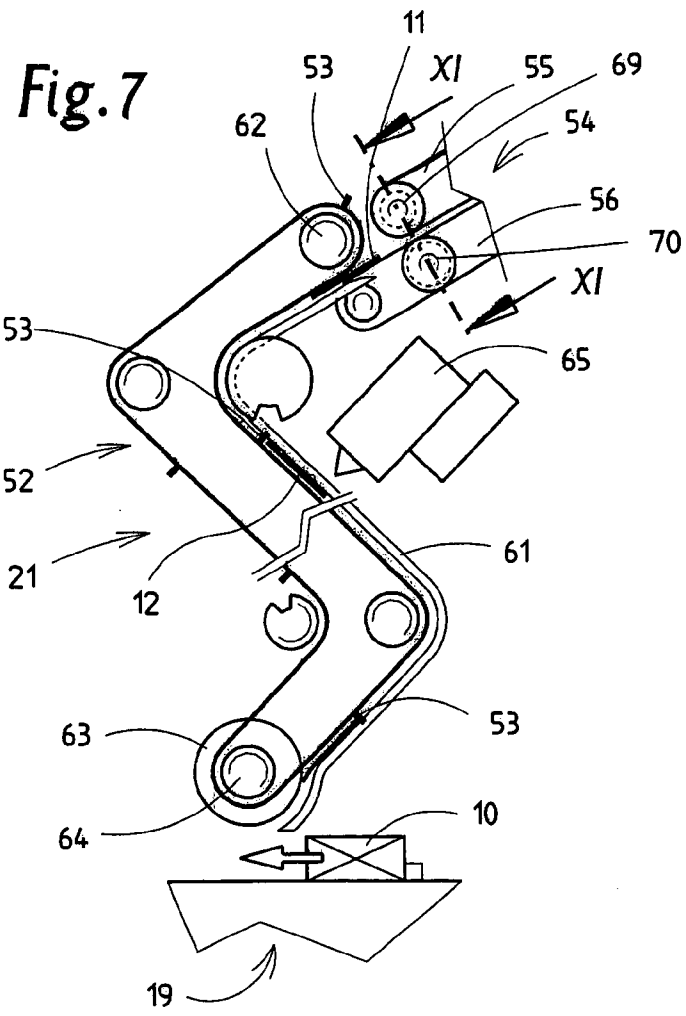
FIG. 7 shows, on an enlarged scale, a coupon feeder in side view in the form of detail VII from FIG. 6.

As an alternative, the coupons 11, 12 may be supplied directly to the feeder 21 by the coupon conveyor 17 and transferred to the pack 10 by said feeder. In the case of this solution, the feeder 21 is designed in a specific manner (FIGS. 7 and 8).

One of the tasks of the coupon conveyor 17 is to transport the coupons 11, 12, once received from the coupon subassembly 14, over a relatively long conveying distance. The coupon conveyor 17, according to FIG. 3, is designed such that the two adjacently supplied coupons 11, 12, during transportation, are moved into a position relative to one another in which they are offset and, finally, follow one after the other. This result is achieved by temporarily different conveying speeds of the two coupons 11, 12. Receiving belts 23, 24, which follow the coupon subassembly 14, are driven at different conveying speeds, this resulting in the offset of the coupons 11, 12 which can be gathered from FIG. 3 being established. The receiving belt 24, which is arranged on the right, runs at a higher speed here than the receiving belt 23.

Each receiving belt 23, 24 comprises two individual belts which interact with one another. These each butt against one another by way of conveying strands, the coupons 11, 12 being positioned and fixed between the mutually facing conveying strands. Furthermore, the (in each case two) receiving belts 23, 24 are formed, by a corresponding arrangement of deflecting rollers 25, 26, such that the coupons 11, 12 are turned through 90° during transportation. The coupons 11, 12 are supplied in a horizontal plane and are turned into an upright plane during transportation by the receiving belts 23, 24.

In this position, the coupons 11, 12 are transferred one after the other to an intermediate conveyor 27. The latter leads the coupons 11, 12, which arrive in offset (vertical) planes, to a common connection conveyor 28. The intermediate conveyor 27 comprises converging guide members which supply the coupons 11, 12 to an inlet region of the connection conveyor 28. These are lateral belts 29 which, on account of deflecting rollers with different diameters, form converging conveyor strands Inner guide members, namely likewise converging inner belts 30, are located between the two lateral belts 29, the inner belts 30 having wedge-shaped deflecting components 31 at an end which is directed towards the connection conveyor 28. The coupons 11, 12, which are supplied in two spaced-apart paths, are made to converge between the lateral belt 29, on the one hand, and inner belt 30, on the other hand, and transferred one after the other to the common connection conveyor 28. The latter also comprises two belts, the coupons 11, 12 being transported in a fixed state between the mutually facing conveying strands.

The connection conveyor 28 transfers the coupons 11, 12—still in a vertical conveying plane—to a deflecting conveyor 32. The latter conveys the coupons 11, 12 into a direction which is offset or deflected through 90°. The deflecting conveyor 32 comprises an inner conveyor 33 and an angled outer conveyor 34. The two conveyors 33, 34 are formed by belts which are guided over three deflecting rollers. A central deflecting roller 35 of the inner conveyor 33 brings about the change in direction during transportation of the coupons 11, 12. The belts of the inner conveyor 33 butt directly against the deflecting roller 35. An angled conveying strand of the outer conveyor 34 butts indirectly, namely via the belt of the inner conveyor 33, likewise against the deflecting roller 35. The coupons 11, 12 are transported therebetween.

A turning conveyor 36 follows on an outlet side of the deflecting conveyor 32. This turning conveyor comprises two individual belts 37, 38 which interact and have the coupons 11, 12 positioned between their conveying strands. Deflecting rollers 39, 40 have their axes of rotation offset through 90° in relation to one another, with the result that the individual belts 37, 38 are turned from an upright plane on the inlet side into a horizontal plane in the region of the deflecting roller 40. The coupons 11 are correspondingly turned into a horizontal position.

This is followed by an end conveyor 41 with two horizontally running belts for receiving the coupons 11, 12 and passing them on either to the coupon magazine 22 (FIG. 3) or to the coupon feeder 21 (FIGS. 7 and 8).

The coupon magazine 22 in the configuration shown constitutes a special feature. It comprises two shafts 42, 43 which are offset in relation to the end conveyor 41. These shafts are arranged in an upright position and each serve for receiving a coupon stack 44.

Coupons 11, 12 are removed one after the other from the underside of the coupon magazine 22 or of each shaft 42, 43. The removal member or the feeder 20 is configured in the customary manner.

The coupons 11, 12 supplied by the coupon conveyor 17 are supplied to one shaft 42, 43 or the other as required by sideways movement. For this purpose, the filling level of the coupons 11, 12 in the shafts 42, 43, that is to say the height of the coupon stack 44, is checked, for example by light barriers. If the height of a coupon stack 44 drops below a certain level, coupons 11, 12 are correspondingly additionally conveyed into the relevant shaft 42, 43. For this purpose, a coupon distributor 45 is arranged between the shafts 42, 43, to be precise in extension of the conveying direction of the end conveyor 42. This coupon distributor comprises two distributor members, namely conveying rollers 46 and 47. The bottom conveying roller 47 is arranged beneath the infeed plane of the coupons 11, 12 and the top conveying roller 46 is arranged above the same. Located between the two conveying rollers 46, 47, which can be rotated about a horizontal axis, is an interspace 48, in the region of which the-coupons 11, 12 are transferred to the coupon distributor 45. The conveying rollers 46, 47 are provided with bores 49 along the circumference. The hollow conveying rollers 46, 47 are connected to an air subassembly (not shown), to be precise such that the conveying rollers 46, 47 can alternatively be supplied with negative pressure, that is to say suction air, or with positive pressure, that is say compressed air. Furthermore, the conveying rollers 46, 47 are driven in opposite directions.

Figure 5:
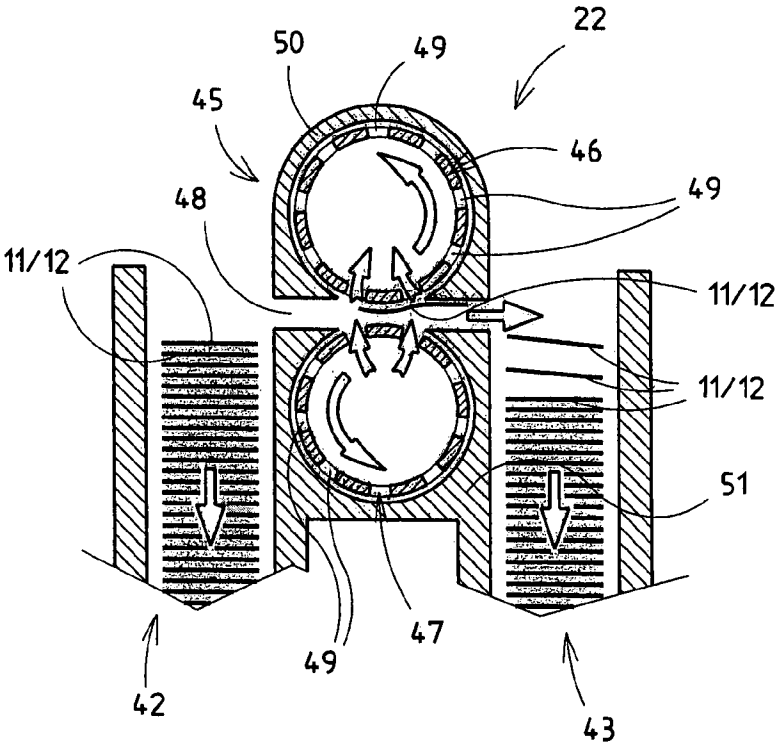
FIG. 5 shows, on an enlarged scale, a detail of a coupon magazine in a side view and/or in a (vertical) section V-V from FIG. 3.

In the case of the exemplary embodiment shown in FIG. 5, the (right-hand) shaft 43 is to be supplied with coupons 11, 12. The (top) conveying roller 46 is subjected to the action of suction air, with the result that the incoming coupons 11, 12 have a sub-region butting against the circumference of the conveying roller 46. By virtue of rotation in the anticlockwise direction, the relevant coupon 11, 12 is supplied to the shaft 43. The abutment of the coupon 11, 12 against the circumference of the conveying roller 46 is assisted by compressed air passing out of the bores 49 of the other (bottom) conveying roller 47. Both conveying rollers 46, 47 are enclosed by a guide or a housing 50, 51. The latter exposes merely a small, limited region of the circumference of the conveying rollers 46, 47 in the region of the interspace 48. A sub-region of the coupons 11, 12 butts in each case against one housing 50, 51 or the other, with the result that the coupons 11, 12, being peeled off the circumference of the respective conveying roller 46, 47, are supplied to one shaft 42, 43 or the other. If the other shaft 42 is to be supplied, the supply of suction air and compressed air is reversed such that the coupons 11, 12 butt against the circumference of the bottom conveying roller 47 and are supplied by the latter to the shaft 42.

As an alternative, the coupons 11, 12 may be supplied by the coupon conveyor 17 directly to the specifically designed feeder 21. The latter comprises at least one conveyor for the coupons 11, 12, in the present case a feeder belt 52, which is designed such that the incoming coupons 11, 12 are transported such that they coincide precisely with the conveying movement of the packs 10, and are transferred to the associated pack 10. The feeder 21 or the feeder belt 52 thereof is thus driven in dependence on the central machine drive and/or is connected to this machine drive. Accordingly, the conveying movements of the packs 10 always coincide with the movement of the feeder belt 52. It is also provided that the coupons 11, 12 on the feeder belt 52 have precise relative positioning coordinated with the conveying movement of the packs 10. For this purpose, the feeder belt 52—preferably a toothed belt—has carry-along elements 53 for each coupon 11, 12. The transfer thereof to the feeder 21 is configured such that abutment against the associated carry-along element 53 is achieved at the latest as the coupon 11, 12 is transferred to the pack 10.

Figure 13:
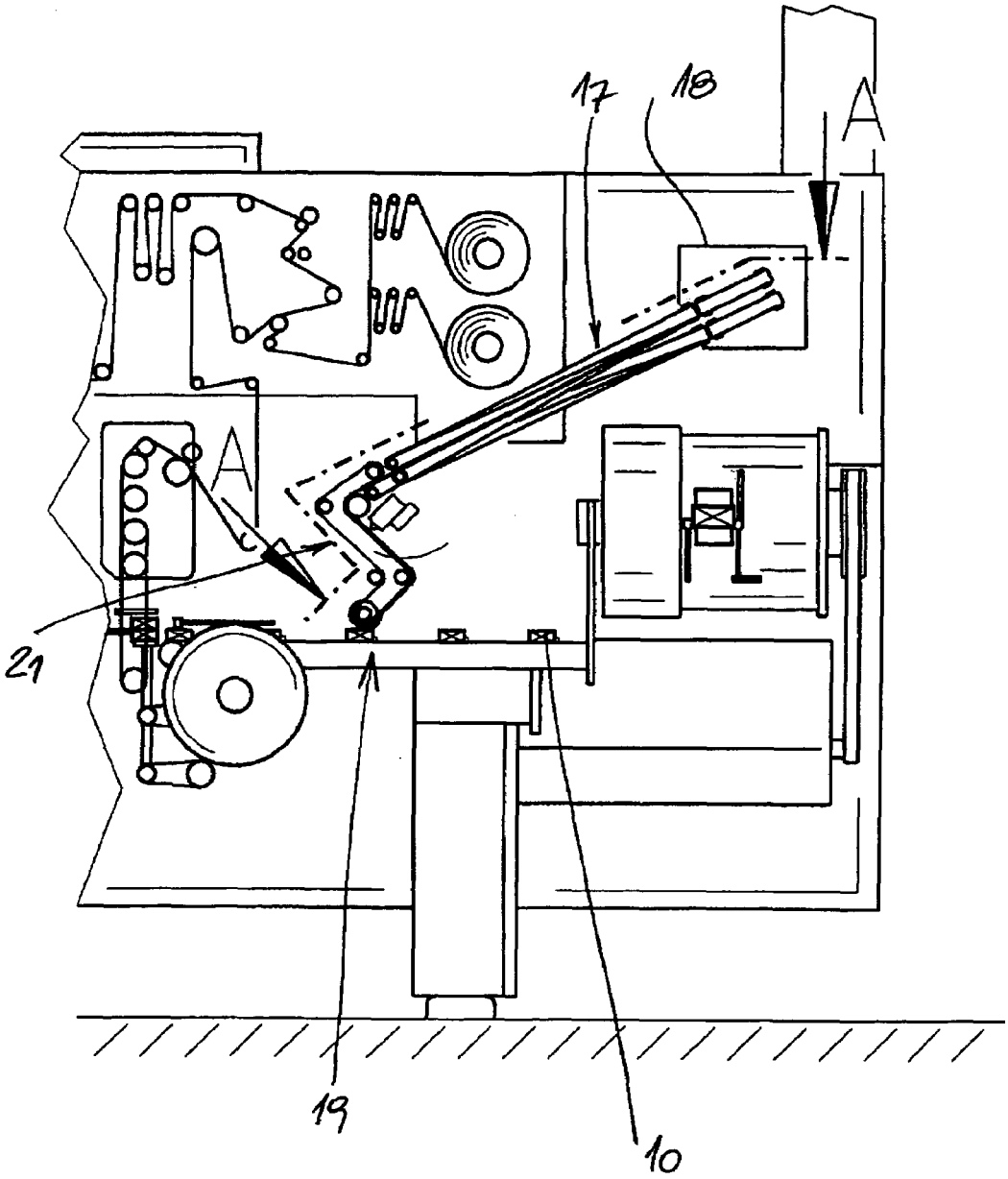
FIG. 13 shows a partial view of a packaging machine similar to FIG. 6, but having a twin-path operation.
Figure 14:
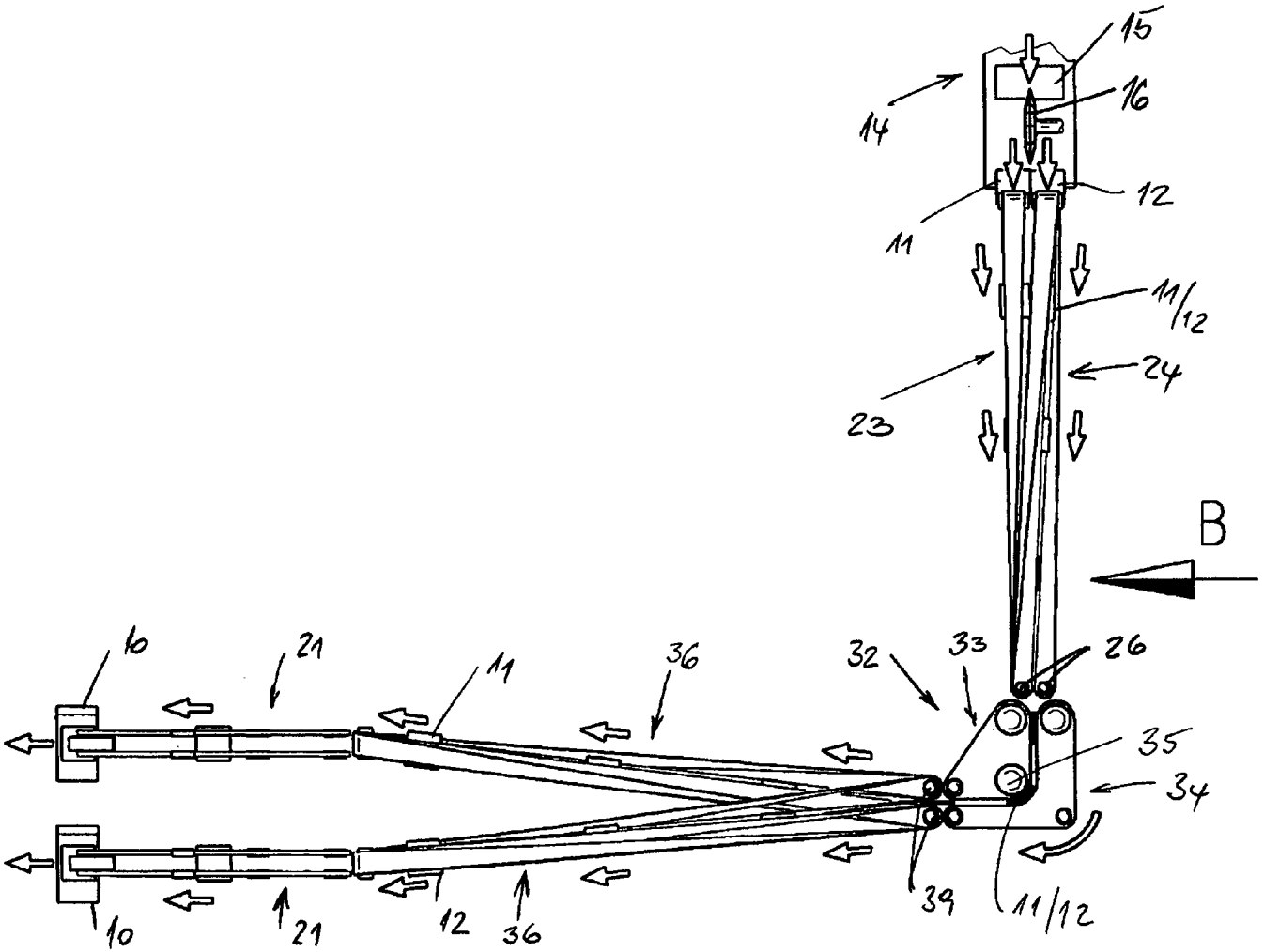
FIG. 14 shows, on an enlarged scale, a top view A of an alternate coupon conveyor shown in FIG. 13 having twin-paths for conveying coupons.
Figure 15:
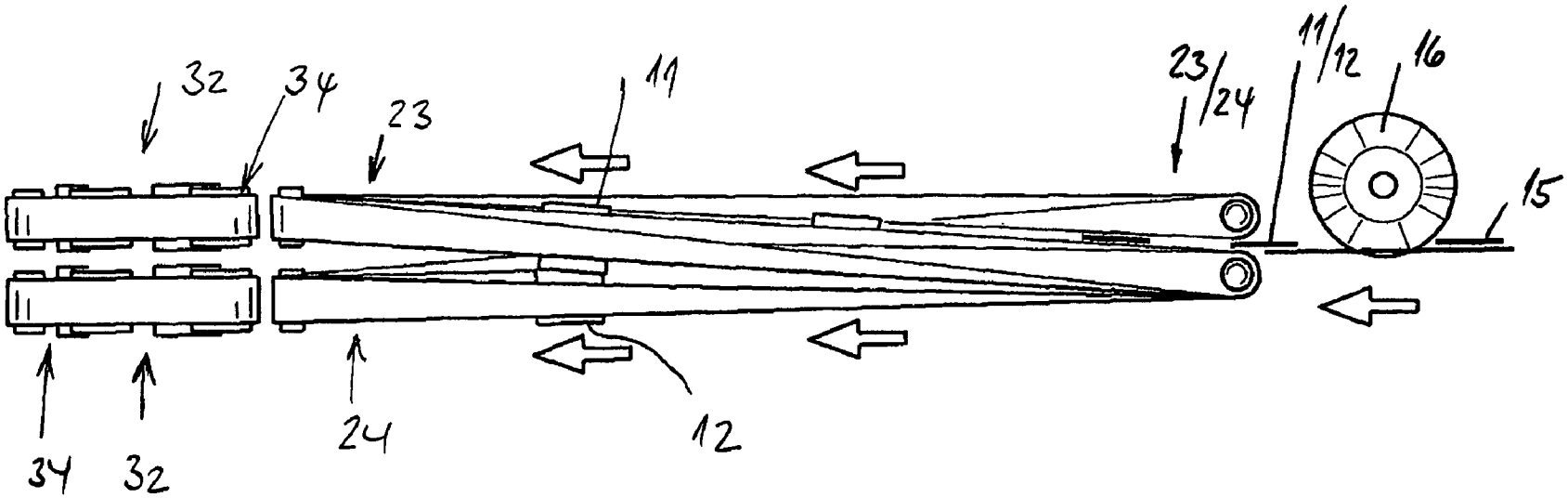
FIG. 15 shows, on an enlarged side, a side view B of the coupon conveyor shown in FIG. 14.

The feeder 21 or the feeder belt 52 thereof follows the coupon conveyor 17 directly. This is designed in a similar manner to that in the exemplary embodiment according to FIG. 3. The end conveyor 41 is replaced by a transfer conveyor 54 comprising a top belt 55 and a bottom belt 56. The latter is extended as a conveyor into the region of the feeder 21 or of the feeder belt 52, with a region of overlap being formed in the process. A deflecting roller 57 of the bottom belt 56 butts (indirectly) against a conveying strand of the feeder belt 52. In the case of this configuration, it is possible for the coupons 11, 12, with single-path operation of the packaging machine, to be supplied to the packs 10 by a single feeder 21. With frequently customary two-path operation of the packaging machine, two feeders 21 are arranged one beside the other and are assigned parallel conveying paths 19 for packs 10. This alternate arrangement is illustrated, for example, by view A of FIG. 6 shown in FIG. 13 and by view B of FIG. 13 which is shown in FIG. 14. The adjacent feeders 21, in this case, are supplied by separate coupon conveyors 17, which are each assigned to one feeder 21. The coupon conveyor 17 here is designed in a similar manner to that in the exemplary embodiment according to FIG. 3, albeit without the feature, which is provided in FIG. 3, of the two simultaneously produced coupons 11, 12 being made to converge on a common conveyor (connection conveyor 28). Rather the coupons 11, on the one hand, and 12, on the other hand, are supplied to the two feeders 21 by individual coupon conveyors 17.

The feeder 21 is designed such that in a (top) region, following the transfer conveyor 54, the predetermined conveying direction of the coupons 11, 12 is continued. It is also provided that a (bottom) end region of the feeder 21, this region being directed towards the packs 10, ensures that the coupons 11, 12 are supplied to the packs 10 in a state in which they are oriented obliquely downwards and in the conveying direction of the packs 10. To provide a compact construction, and in order to span a predetermined height, the feeder 21 is of zigzag design with a top- receiving leg 58, an intermediate leg 59, which adjoins the latter at an (acute) angle, and a transfer leg 60, which, in turn, is directed at an opposite (acute) angle to the intermediate leg 59. Said transfer leg is oriented at an acute angle to the movement path of the packs 10 and in the movement direction of the same. The feeder belt 52 follows this contour of the feeder 21 by way of correspondingly offset deflecting rollers.

Figure 9:
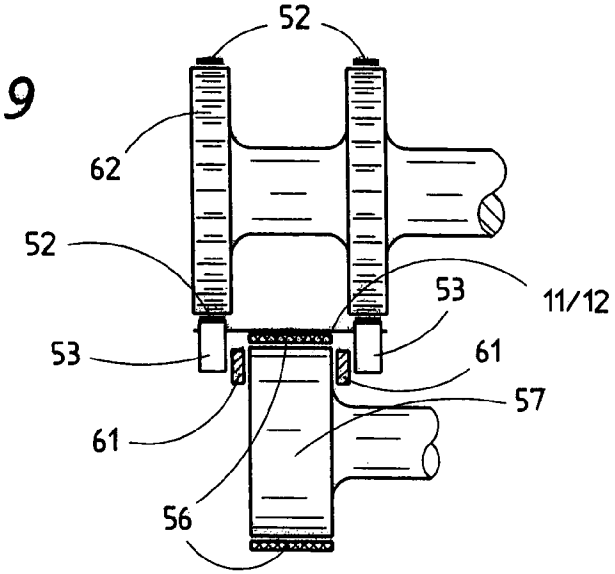
FIG. 9 shows a cross section through a detail of the coupon feeder according to FIG. 8 along section plane IX-IX.

The coupons 11, 12 are transported on a bottom strand of the feeder belt 52 in each case in the region of the receiving leg 58 and of the transfer leg 60. Provided for the purpose of fixing the coupons 11, 12 on the feeder belt 52 is a stationary guide 61, which follows the contour of the feeder 21 and/or a conveying strand of the feeder belt 52, in close proximity thereto. As can be seen from FIG. 9, the guide 61 comprises two spaced-apart crosspieces. In certain regions of the feeder belt 52 and/or of the conveying strand, the coupons 11, 12 butt with sliding action against the guide 61. In the inlet region, namely in the region of a top deflecting roller 62, the coupons 11, 12 are introduced between the feeder belt 52 and guide 61. The movement sequence is controlled such that the respective coupon 11, 12 is introduced at a certain distance in front of the associated carry-along element 53 (FIG. 7). By virtue of the difference in speeds and/or by virtue of the coupons 11, 12 butting against the guide 61, the carry-along element 53 follows and intercepts the coupon 11, 12 with precise relative positioning.

Figure 10:
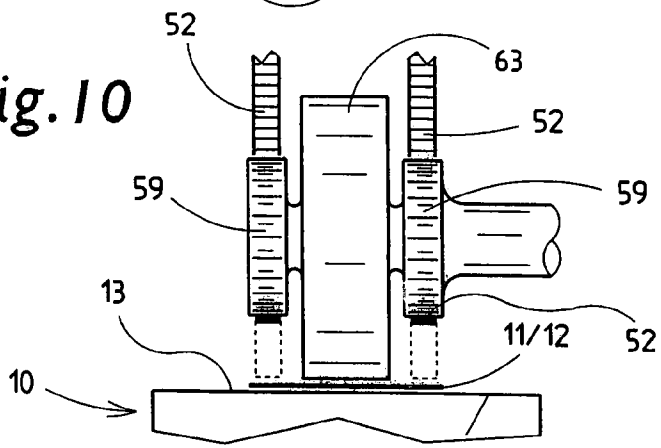
FIG. 10 shows a further detail of the coupon feeder according to FIG. 8 along section plane X-X.

Provided in the region of the transfer leg 60 is a separate, circulating transfer member for applying the coupons 11, 12 to the top side 13 of the packs 10. This transfer member is a pressure-exerting wheel 63, which is arranged on a spindle or (drive) shaft for deflecting rollers 64 for the feeder belt 52. As can be seen from FIGS. 9 and 10, the feeder belt 52 comprises two spaced-apart, parallel individual belts (toothed belts) with correspondingly spaced-apart deflecting rollers. The pressure-exerting wheel 63 is arranged between the end deflecting rollers 64 and has a considerably larger diameter than these deflecting rollers 64. By virtue of the position and size of the pressure-exerting wheel 63, the coupon 11, 12 supplied by the conveying strand of the feeder belt 52 is raised up from the feeder belt 52 and conveyed along the circumference of the pressure-exerting belt 63 and applied to the pack 10 (FIG. 8). The guide 61 here is configured by an arcuate convexity such that it is adapted to the contour of the pressure-exerting wheel 63. The pressure-exerting wheel 63 is driven along in rotation by the feeder belt 52, with the result that the coupons 11, 12 are transferred during the rotary movement of the pressure-exerting wheel 63.

The coupons 11, 12 are expediently fixed by glue on the top side 13 of the pack 10. Provided in the region of the feeder 21 is a glue subassembly 65 with glue nozzle, by means of which a side of the coupons 11, 12 which is exposed as the coupons 11, 12 are transported, and is to be applied to the pack 10, is provided with glue as the coupons move past, to be precise in the region of the intermediate leg 59, in which the relevant side of the coupons 11, 12 is oriented (obliquely) upwards.

The packs 10 provided with coupons 11, 12 are supplied, along the conveying path 19, to a blank subassembly 66, which makes available a blank for the outer wrapper and positions the same around the pack 10. The outer wrapper is finished off in a known manner.

Another special feature is that the coupons 11, 12, multiply folded if required, are stabilized during transport with respect to their form, i.e. in particular with respect to their folding, by means of pressure applied by separate pressure-exerting elements. These are pressure rollers or pressure discs 67, 68 which are arranged in pairs at either side of the movement path of the coupons 11, 12. The pressure-exerting elements, or pressure plates 67, 68 are arranged in pairs at either side of the movement path of the coupons 11, 12, to be precise in lateral regions, namely in the region of folds or folding edges which are pressed together by the circumferential surfaces of the pressure discs 67, 68 which are held at a slight distance from one another. The pressure discs in the shown exemplary embodiment are arranged the region of the deflection wheels 69, 70 of endless conveyors, here at the end of the transfer conveyor 54 along the same axis as the deflection wheels 69, 70 for the top belt 55 and bottom belt. The pressure discs 67, 68 are arranged on the same axis or shaft as the deflection wheels 69, 70, specifically at either end of same, having a diameter which makes it possible to transfer pressure on the coupons 11, 12 in this region of the conveying path.

The invention claimed is:

1. An apparatus for the transport, in a conveying direction, of blanks, namely printing carriers or coupons (11, 12), which are fed as an insert to a pack (10) in a region of a packaging machine, characterized by the following features:

a) arranged at a rear side of the packaging machine is a coupon subassembly (14) which produces double-coupons (15) in succession and which comprises a severing element that severs the double-coupons in the middle thereof and produces two individual coupons (11, 12) lying adjacent to one another, b) following the coupon subassembly (14) in the conveying direction, a coupon conveyor (17) receiving the individual coupons (11, 12) and transporting the individual coupons (11, 12) in the region of the packaging machine, c) the coupon conveyor (17) comprises receiving belts (23, 24) assigned to each of the two adjacent coupons (11, 12), d) means for driving the receiving belts (23, 24) at different conveying speeds such that the two adjacent coupons (11, 12) become spaced apart from one another in the conveying direction during transport, e) offset deflecting rollers which turn the receiving belts (23, 24) in the conveying direction such that the individual coupons (11, 12) are turned through 90° from an original position during transport, f) following the receiving belts (23, 24), an intermediate conveyor (27) which merges the individual coupons to a common conveying plane such that the coupons (11, 12) are transported in succession in a common conveying plane, g) following the intermediate conveyor (27), a deflecting conveyor (32) which deflects the individual coupons by approximately 90° with respect to the conveying direction, h) following the deflecting conveyor (32), a turning conveyor (36) which pivots the coupons (11, 12) back into a plane corresponding to their original position, i) following the turning conveyor (36), a coupon magazine (22) which receives the individual coupons, or a coupon feeder (20, 21) which immediately transfers the coupons (11, 12) to a pack (10).

2. The apparatus according to claim 1, characterized in that each receiving belt (23, 24) comprises two individual belts which interact with one another, with each belt transporting coupons (11, 12) between mutually facing conveying strands and with deflecting rollers at a discharge end of the receiving belts (23, 24) being offset in terms of their rotating axes by 90° with respect to deflecting rollers (25) in the region of an admission end of the receiving belts (23, 24).

3. The apparatus according to claim 1, characterized in that the intermediate conveyor (27) comprises guide members converging in the conveying direction, namely lateral belts (29) and inner belts (30), each associated with a respective receiving belt (23 resp. 24) which form conveying planes for the coupons (11, 12) converging in the conveying direction such that, following the intermediate conveyor (27), the coupons (11, 12) are transported in a common plane by a connection conveyor (28).

4. The apparatus according to claim 1, characterized in that the deflecting roller (32) for altering the conveying direction of the coupons (11, 12) by 90° comprises an inner conveyor (33) and an outer conveyor (34), which by being deflected around an inner deflecting roller form two conveying sections arranged at an angle of 90° to each other.

5. The apparatus according to claim 1, characterized by the following features:

a) the feeder(s) directly following the coupon conveyor (17) comprise(s) a feeder belt (52), b) the feeder belt (52) is guided around deflecting rollers and angled a number of times to form a top receiving leg (58), a transversely directed intermediate leg (59) and a transfer leg (60) which is yet again directed transversely, c) the transfer leg (60) of the feeder belt (52) is directed at an acute angle in the conveying direction of the packs (10) above a conveying path (19) for the packs (10).

6. The apparatus according to claim 5, characterized in that the coupons (11, 12) abut a feeder belt (52) and are held in abutment thereto by a fixed guide (61) which follows the contour of the feeder (21), the coupons (11, 12) being transported by carry-along elements (53) in a precise position relative to the packs (10) to be fed.

7. The apparatus according to claim 1, characterized in that pressure-exerting elements for stabilizing foldings in the coupons (11, 12) are arranged in the transport path of the coupons (11, 12), namely pressure discs (67, 68) at either side of belt conveyors, in the region of deflection wheels (69, 70) of a transfer conveyor (54) of the coupons (11, 12) to a feeder (21).

8. An apparatus for the transport of blanks, namely printing carriers or coupons (11, 12), which are fed as an insert to a pack (10) in the region of a packaging machine, characterized by the following features:

a) arranged at a rear side of the packaging machine is a coupon subassembly (14) which produces double-coupons (15) in succession which are severed in the middle by a severing element for the purpose of producing two individual coupons (11, 12) lying adjacent to one another, b) following the coupon subassembly (14), a coupon conveyor (17) for transporting in a conveying direction the coupons (11, 12) in pairs in the region of the packaging machine, c) coupon conveyor (17) comprises receiving belts (23, 24) assigned to each of the two adjacent coupons (11, 12), d) an arrangement of offset deflecting rollers (25, 26) for turning the receiving belts (23, 24) in the conveying direction such that the coupons (11, 12) are turned through 90° from their original position during transport, e) deflecting conveyors (32), following the receiving belts (23, 24), for deflecting the coupons (11, 12) approximately 90° with respect to the conveying direction, f) following the deflecting conveyor (32), a turning conveyor (36) for pivoting the coupons (11, 12) back into a plane corresponding to their original position, and g) following the turning conveyor (36), a coupon feeder (20, 21) for immediately transferring the coupons (11, 12) to one pack (10) each.

9. The apparatus according to claim 8, characterized in that each receiving belt (23, 24) comprises two individual belts which interact with one another, with each belt transporting coupons (11, 12) between mutually facing conveying strands and with deflecting rollers at a discharge end of the receiving belts (23, 24) being offset in terms of their rotating axes by 90° with respect to deflecting rollers (25) in the region of an admission end of the receiving belts (23, 24).

10. The apparatus according to claim 8, characterized in that the intermediate conveyor (27) comprises guide members converging in the conveying direction, namely lateral belts (29) and inner belts (30), each associated with a respective receiving belt (23 resp. 24), which form conveying planes for the coupons (11, 12) converging in the conveying direction such that, following the intermediate conveyor (27), the coupons (11, 12) are transported in a common plane by a connection conveyor (28).

11. The apparatus according to claim 8, characterized in that the deflecting roller (32) for altering the conveying direction of the coupons (11, 12) by 90° comprises an inner conveyor (33) and an outer conveyor (34), which by being deflected around an inner deflecting roller form two conveying sections arranged at an angle of 90° to each other.

12. The apparatus according to claim 8, characterized by the following features:

a) the coupon magazine (22) arranged at the end of the coupon conveyor (17) has two laterally offset shafts (42, 43) spaced at a distance from one another for each coupon stack (44), b) arranged between the two shafts (42, 43) is a coupon distributor (45) directly following the coupon conveyor (17), c) the coupon distributor (45) transports the coupons (11, 12) in one shaft or the other (42, 43) depending on the degree to which said shafts (42, 43) are filled.

13. The apparatus according to claim 12, characterized in that the coupon distributor (45) comprises two conveying rollers (46, 47) which are arranged one above the other and supply the coupons (11, 12) to one shaft (42, 43) or the other by the corresponding rotary movement of the conveying rollers (46, 47), the coupons (11, 12) being fixed by suction air to the circumference of the conveying rollers (46, 47) via bore holes (49).

14. The apparatus according to claim 8, characterized by the following features:

a) a feeder directly following the coupon conveyor (17) comprises a feeder belt (52), b) the feeder belt (52) is guided around deflecting rollers and angled a number of times to form a top receiving leg (58), a transversely directed intermediate leg (59) and a transfer leg (60) which is yet again directed transversely, c) the transfer leg (60) of the feeder belt (52) is directed at an acute angle in the conveying direction of the packs (10) above a conveying path (19) for the packs (10).

15. The apparatus according to claim 14, characterized in that the coupons (11, 12) abut a feeder belt (52) and are held in abutment thereto by a fixed guide (61) which follows the contour of the feeder (21), the coupons (11, 12) being transported by carry-along elements (53) in a precise position relative to the packs (10) to be fed.

16. The apparatus according to claim 8, characterized in that pressure-exerting elements for stabilizing foldings in the coupons (11, 12) are arranged in the transport path of the coupons (11, 12), namely pressure discs (67, 68) at either side of belt conveyors, in the region of deflection wheels (69, 70) of a transfer conveyor (54) of the coupons (11, 12) to a feeder (21).

* * * * *